US008216752B2

(12) United States Patent
Sakimura et al.

(10) Patent No.: US 8,216,752 B2
(45) Date of Patent: Jul. 10, 2012

(54) ORGANIC PHOTORECEPTOR AND IMAGE FORMING APPARATUS

(75) Inventors: Tomoo Sakimura, Tokyo (JP); Takeshi Ishida, Tokyo (JP)

(73) Assignee: Konica Minolta Business Technologies, Inc. (JP)

( * ) Notice: Subject to any disclaimer, the term of this patent is extended or adjusted under 35 U.S.C. 154(b) by 691 days.

(21) Appl. No.: 12/334,983

(22) Filed: Dec. 15, 2008

(65) Prior Publication Data

US 2009/0154960 A1 Jun. 18, 2009

(30) Foreign Application Priority Data

Dec. 18, 2007 (JP) ..... 2007-325628

(51) Int. Cl.
*G03G 5/00* (2006.01)

(52) U.S. Cl. ..... 430/72; 430/57.1; 430/59.1; 399/220

(58) Field of Classification Search ..... 430/57.1, 430/59.1, 72; 399/220
See application file for complete search history.

(56) References Cited

U.S. PATENT DOCUMENTS 4,925,760 A * 5/1990 Baranyi et al. ..... 430/58.8
RE33,724 E * 10/1991 Takei et al. ..... 430/58.4
2006/0188798 A1* 8/2006 Tokutake et al. ..... 430/60

FOREIGN PATENT DOCUMENTS

JP 1-173042 * 7/1989
JP 2000-47408 2/2000

OTHER PUBLICATIONS

Machine translation , JP2000-047408.*

* cited by examiner

*Primary Examiner* — Thorl Chea
(74) *Attorney, Agent, or Firm* — Cantor Colburn LLP

(57) ABSTRACT

An objective is to provide an organic photoreceptor exhibiting high sensitivity, suitable for exposure to a semiconductor laser having an emission wavelength of 350-500 nm or a light emitting diode, with which generation of memory images as well as image defects caused by very small charge leakage is inhibited, and also to provide an image forming apparatus fitted with the organic photoreceptor. Also disclosed is an organic photoreceptor possessing a charge generation layer and a charge transport layer provided on a conductive support, wherein the charge generation layer contains particles made of a condensed polycyclic pigment, having an average major axis length of 500 nm or less, an average aspect ratio of 2.5-5.0, and an aspect ratio variation coefficient of 16% or less.

4 Claims, 3 Drawing Sheets

ORGANIC PHOTORECEPTOR AND IMAGE FORMING APPARATUS

This application claims priority from Japanese Patent Application No. 2007-325628 filed on Dec. 18, 2007, which is incorporated hereinto by reference.

TECHNICAL FIELD

The present invention relates to an organic photoreceptor employing a novel pyranthrone based compound utilized for electrophotographic image formation, and an image forming apparatus thereof.

BACKGROUND

In recent years, opportunities to use an electrophotographic copier and a printer have been increased in the field of printing as well as color printing. In the field of printing as well as color printing, high quality digital monochromatic or color images tend to be demanded. In order to respond to such the demand, it is proposed that a laser light having a short wavelength is employed as a source for exposure to light to form high definition digital images. However, the electrophotographic image finally obtained has not sufficiently achieved high image quality, even though the laser light having a short wavelength is employed, and the dot size of exposure is narrowed to form a minute electrostatic latent image on the electrophotographic photoreceptor.

The reason is that photosensitive properties of the electrophotographic photoreceptor, an electrification characteristic of toner in a developer and so forth do not satisfy properties desired for formation of minute dot latent images as well as formation of toner images.

That is, in cases where the electrophotographic photoreceptor is an organic photoreceptor developed for a conventional long wavelength laser, (hereinafter, also referred to simply as a photoreceptor), reproducibility of dot images tends to be degraded since a sensitivity characteristic is degraded, and no clear dot latent image is formed, when imagewise exposure in which the dot size of exposure is narrowed is conducted with laser light having a short wavelength.

Anthanthrone based pigments and pyranthrone based pigments are conventionally well known as a charge generation material in a photoreceptor utilized for a short wavelength laser (Patent Document 1). However, there is no description in Patent Document 1 concerning polycyclic quinone pigments such as the anthanthrone based pigments subjected to a specific treatment, and they are simply considered to be commercially available pigments, but as for properties such as sensitivity and so forth obtained when these commercially available pigments are employed, neither sensitivity nor high speed performance is sufficiently obtained with a high speed printer and copier equipped with a short wavelength laser which is expected to be developed in the near future. On the other hand, it is well known that the charge generation material size is minimized to form a charge generation layer having high density of the charge generation material in order to improve sensitivity. However, when this particle-minimizing technique is applied to a photoreceptor suitable for a short wavelength laser, sensitivity itself is improved, but image defects caused by generation of memories and very small charge leakage via repetitive electrification in a charging step and a transfer step during image formation tend to be generated.

(Patent Document 1) Japanese Patent O.P.I. Publication No. 2000-47408

SUMMARY

The present invention was made on the basis of the above-described problems. It is an object of the present invention to provide an organic photoreceptor exhibiting high sensitivity (hereinafter, also referred to simply as a photoreceptor), suitable for exposure to a semiconductor laser having an emission wavelength of 350-500 nm or a light emitting diode, with which generation of memory images as well as image defects caused by very small charge leakage are inhibited, and also to provide an image forming apparatus fitted with the organic photoreceptor.

BRIEF DESCRIPTION OF THE DRAWINGS

Embodiments will now be described, by way of example only, with reference to the accompanying drawings which are meant to be exemplary, not limiting, and wherein like elements numbered alike in several figures, in which.

DESCRIPTION OF THE PREFERRED EMBODIMENTS

Figure 1:
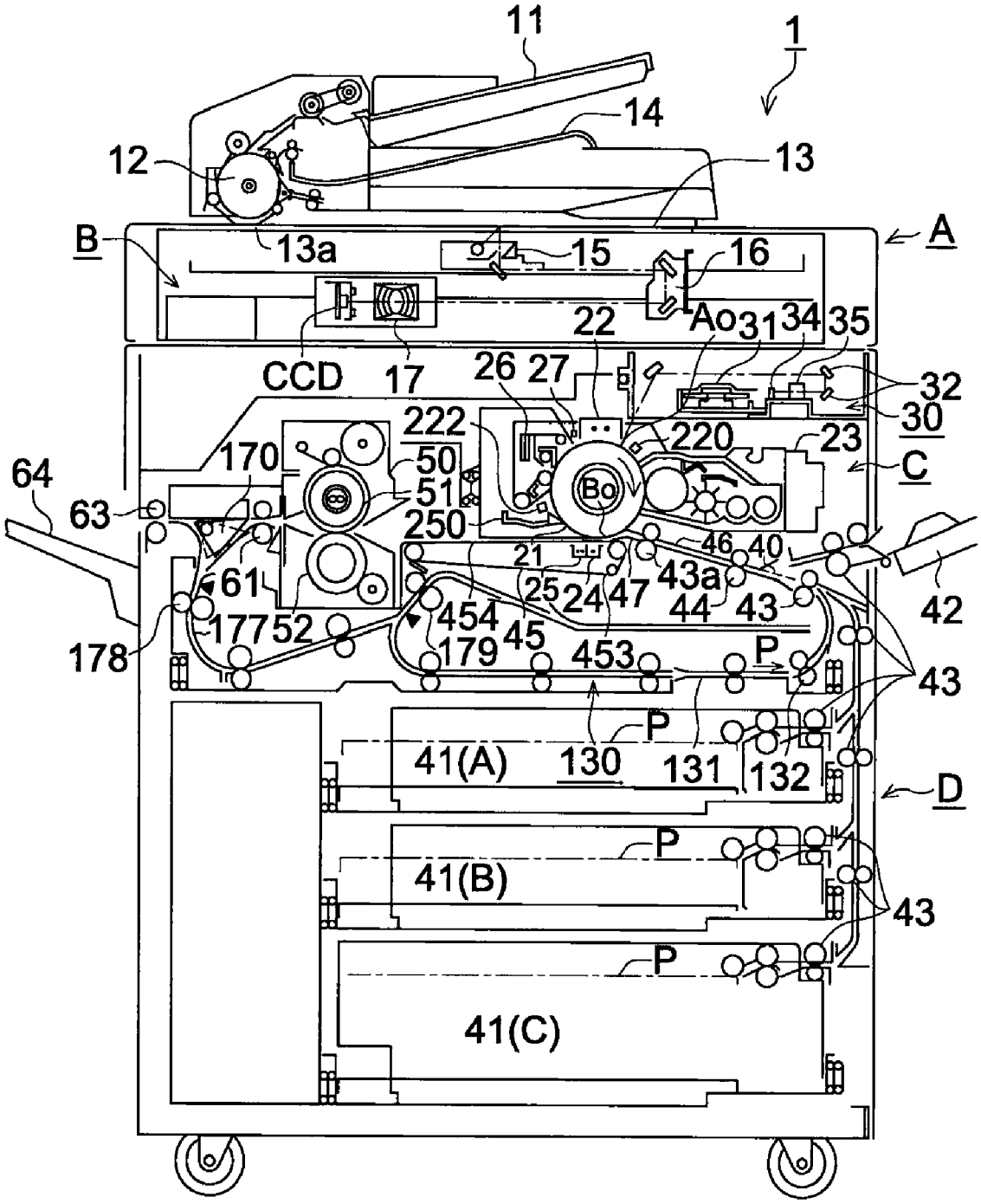
FIG. 1 is a schematic diagram of an image forming apparatus fitted with functions therein.

After considerable effort during intensive studies concerning the above-described problems, the inventors have found out that when a charge generation material made of a condensed cyclic pigment is arranged to be in the form of a bale (or of a straw bag), dispersiblity of the pigment in an charge generation layer can be improved, whereby not only sensitivity is improved, but also generation of memory images as well as image defects caused by very small charge leakage can be inhibited, thereby accomplishing the present invention.

That is, the present invention is accomplished by using organic photoreceptors having the following constituents.

(Structure 1) An organic photoreceptor comprising a charge generation layer and a charge transport layer provided on a conductive support, wherein the charge generation layer comprises particles made of a condensed polycyclic pigment, having an average major axis length of 500 nm or less, an average aspect ratio of 2.5-5.0, and an aspect ratio variation coefficient of 16% or less.

(Structure 2) The organic photoreceptor of Structure 1, wherein the condensed polycyclic pigment is a compound represented by the following Formula (1):

Formula (1)

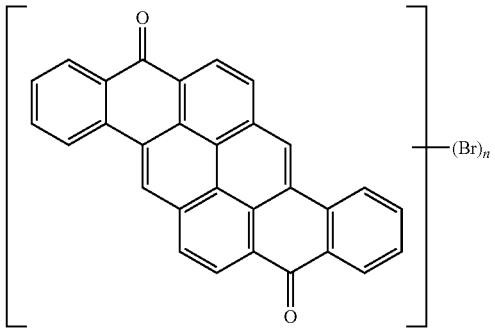

, wherein n is an integer of 1-6.

(Structure 3) The organic photoreceptor of Structure 1 or 2, wherein the condensed polycyclic pigment is a charge generation material.

(Structure 4) The organic photoreceptor of Structure 3, wherein the charge generation layer comprises the charge generation material and a binder resin, the charge generation material having a content of 20-600 parts by weight, with respect to 100 parts by weight of the binder resin.

(Structure 5) The organic photoreceptor of Structure 4, comprising the charge generation layer formed by coating a dispersion prepared via multi-dispersion steps.

(Structure 6) An image forming apparatus comprising the organic photoreceptor of any one of Structures 1-5; a charging device to charge the organic photoreceptor; an exposure device to form an electrostatic latent image by exposing the organic photoreceptor charged with the charging device to light; a developing device to form a toner image via development of the electrostatic latent image with a toner; and a transfer device to transfer the toner image from the organic photoreceptor to a transfer medium, wherein the exposure device comprises an exposure light source of monochromatic light having a wavelength of 350-500 nm.

While the preferred embodiments of the present invention have been described using specific terms, such description is for illustrative purposes only, and it is to be understood that changes and variations may be made without departing from the spirit or scope of the appended claims.

DETAILED DESCRIPTION OF THE INVENTION

In the present invention, utilized is an organic photoreceptor possessing a charge generation layer and a charge transport layer provided on a conductive support, wherein the charge generation layer comprises particles made of a condensed polycyclic pigment, having an average major axis length of 500 nm or less, an average aspect ratio of 2.5-5.0, and an aspect ratio variation coefficient of 16% or less.

First, definition of a major axis length, a minor axis length and an aspect ratio of the particle made of a condensed polycyclic pigment will be described.

The major axis length and the minor axis length of a particle made of a condensed polycyclic pigment of the present invention are determined from a contour of the particle obtained from a planar photographic image via photographing of the particle. First, when the above-described contour is sandwiched between two parallel lines tangent to the contour, two parallel lines by which the spacing between the two lines is maximized is determined, and a segment made from a straight line, by which two contact points bringing these two parallel lines into contact with the contour of the particle are connected, is called a major axis. The length of this segment is defined as "major axis length". Next, a segment made from a straight line passing through the center of the resulting major axis length and being drawn on the same plane as that of the contour, by which two points at which a perpendicular line intersects with the contour of the particle are connected, is called a minor axis, and the length of this segment is defined as "minor axis length".

In order to measure the major and minor axes of a particle made of the polycyclic pigment, an enlarged micrograph of the pigment particle was photographed at a magnification of 2000 times employing a scanning electron microscope (manufactured by JEOL Ltd.), and conducted was an analysis of the photographic image scanned by a scanner employing an automatic image processing analyzer (Luzex AP, manufactured by Nireco Corporation) fitted with software version Ver. 1.32. In this case, the major axis and the minor axis of each of 1000 pigment particles were determined to measure the major axis length and the minor axis length, and an average major axis length, an average aspect ratio and an aspect ratio variation coefficient which are defined below are calculated.

Definition of Average Major Axis Length

The average major axis length of the present invention is an average value of major axis lengths of the above-described 1000 pigment particles.

Definition of Average Aspect Ratio

First, the aspect ratio is a ratio of (major axis length/minor axis length) of a pigment particle.

The average aspect ratio of the present invention is an average value of the aspect ratios of the above-described 1000 pigment particles.

Definition of Aspect Ratio Variation Coefficient

The aspect ratio variation coefficient in the present invention is calculated by the following equation.

$$\text{Aspect ratio variation coefficient}=[S/K]\times 100$$

where S represents a standard deviation of aspect ratios of 1000 pigment particles, and K represents an average value of aspect ratios of 1000 pigment particles. Further, a polycyclic quinone pigment, a perylene pigment or the like is provided as a condensed polycyclic pigment of the present invention, but as the polycyclic pigment of the present invention, a compound represented by foregoing Formula (1) is preferable. A synthetic example of the compound represented by Formula (1) is described below.

Next, the compound represented by foregoing Formula (1) in the present invention will be described.

In the compound represented by Formula (1), the number n of substituted Br is 1-6, and substitution positions of those (Br) are substitutable at positions of $R_1$-$R_{14}$ in the following Formula (2).

Formula (2)

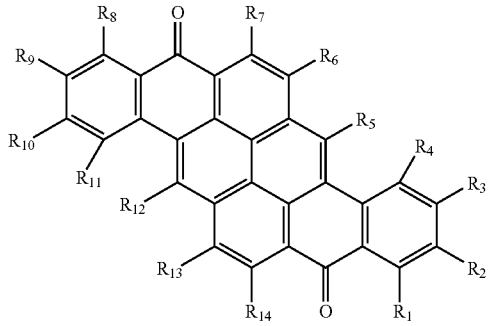

However, since the means to precisely identify the substitution position of Br is not established, the substitution position can not be precisely identified.

Further, the compound represented by foregoing Formula (1) is shown in the following synthetic example, and obtained as an admixture with the number of substitution Br represented by n being a plural number, and the admixture is preferably utilized as charge generation material (CGM) in a charge generation layer.

A synthetic example of the compound represented by foregoing Formula (1) in the present invention will be described below.

SYNTHETIC EXAMPLE 1

CGM-1 (Admixture with n=1-3)

Five gram of 8,16-pyranthrenedione and 0.25 g of iodine were dissolved in 50 g of chlorosulfuric acid and then, 3.0 g of bromine were dropwise added. After the system was heated while stirring at 50° C. for 3 hours, and cooled down to room temperature, the resulting was introduced into 500 g of ice. Then, drying was conducted after filtration and washing to obtain 6.8 g of pigment crude product. Five gram of the pigment crude product was charged into a Pyrex (registered trademark) glass tube, and this tube was placed inside a furnace in which temperature gradient from about 440° C. to about 20° C. was made along the length of the tube (the temperature gradient from about 440° C. to about 20° C. in a length of 1 m). The inside of the glass tube was depressurized to approximately $1\times10^{-2}$ Pa, and the location where the pigment crude product to be refined was placed was heated to 440° C. The prepared vapor was moved to the low temperature side of the tube, and condensed, whereby 2.4 g of sublimate (CGM-1) condensed in the range of about 300-380° C. was obtained.

Mass spectroscopy analysis of CGM-1 was conducted, so that the admixture having n=1-3 was obtained, and the peak intensity ratio of n=1/n=2/n=3 was 11/59/30.

SYNTHETIC EXAMPLE 2

CGM-2 (Admixture with n=3–5)

Five gram of 8,16-pyranthrenedione and 0.25 g of iodine were dissolved in 50 g of chlorosulfuric acid and then, 5.9 g of bromine were dropwise added. After the system was heated while stirring at 70° C. for 5 hours, and cooled down to room temperature, the resulting was introduced into 500 g of ice. Then, drying was conducted after filtration and washing to obtain 8.5 g of pigment crude product. Five gram of the pigment crude product was charged into a Pyrex (registered trademark) glass tube, and this tube was placed inside a furnace in which temperature gradient from about 460° C. to about 20° C. was made along the length of the tube (the temperature gradient from about 460° C. to about 20° C. in a length of 1 m). The inside of the glass tube was depressurized to approximately $1\times10^{-2}$ Pa, and the location where the pigment crude product to be refined was placed was heated to 460° C. The prepared vapor was moved to the low temperature side of the tube, and condensed, whereby 3.3 g of sublimate (CGM-2) condensed in the range of about 300-400° C. was obtained.

Mass spectroscopy analysis of CGM-2 was conducted, so that the admixture having n=3-5 was obtained, and the peak intensity ratio of n=3/n=4/n=5 was 16/67/17.

SYNTHETIC EXAMPLE 3

CGM-3 (Admixture with n=3-6)

Five gram of 8,16-pyranthrenedione and 0.25 g of iodine were dissolved in 50 g of chlorosulfuric acid and then, 5.9 g of bromine were dropwise added. After the system was heated while stirring at 75° C. for 6 hours, and cooled down to room temperature, the resulting was introduced into 500 g of ice. Then, drying was conducted after filtration and washing to obtain 8.7 g of pigment crude product. Five gram of the pigment crude product was charged into a Pyrex (registered trademark) glass tube, and this tube was placed inside a furnace in which temperature gradient from about 480° C. to about 20° C. was made along the length of the tube (the temperature gradient from about 480° C. to about 20° C. in a length of 1 m). The inside of the glass tube was depressurized to approximately $1\times10^{-2}$ Pa, and the location where the pigment crude product to be refined was placed was heated to 480° C. The prepared vapor was moved to the low temperature side of the tube, and condensed, whereby 3.0 g of sublimate (CGM-3) condensed in the range of about 300-420° C. was obtained.

Mass spectroscopy analysis of CGM-3 was conducted, so that the admixture having n=3-6 was obtained, and the peak intensity ratio of n=3/n=4/n ~5/n=6 was 17/51/27/5.

Method of Adjusting Aspect Ratio

In order to adjust an average aspect ratio and an aspect ratio variation coefficient in the present invention, and to fall them within the range of the present invention, multi-dispersion steps employing dispersing beads having high specific gravity are preferably conducted. Herein, the multi-dispersion steps mean a dispersing method by which dispersing is conducted in combination with dispersing with the changed dispersion condition. In the present invention, multi-dispersion steps employing zirconia beads having a small particle diameter are preferable.

As the multi-dispersion steps, conducted are dispersions in such a way that the first dispersion is conducted with no binder, the second dispersion is conducted under a different dispersion condition from that of the first dispersion, and subsequently, the third dispersion is additionally conducted via addition of a binder. As a dispersion composition, the solid content of a pigment is preferably 5-15% by volume, based on a dispersion medium (solvent+binder). In addition, usable examples of homogenizers to conduct the multi-dispersion steps include a sand mill, ball mill, an ultrasonic homogenizer and so forth.

The organic photoreceptor of the present invention is an photoreceptor possessing a charge generation layer and a charge transport layer provided on a conductive support, and the charge generation layer contains particles made of a condensed polycyclic pigment, having an average major axis of 500 nm or less, an average aspect ratio of 2.5-5.0, and an aspect ratio variation coefficient of 16% or less. The structure of the organic photoreceptor having these constituents will be described below.

In the present invention, the organic photoreceptor means an electrophotographic photoreceptor containing an organic compound having at least one of a charge generation function and a charge transport function which are indispensable for constituents of the electrophotographic photoreceptor, and totally includes commonly known organic photoreceptors such as a photoreceptor composed of a commonly known organic charge generation material and a commonly known organic charge transport material, a photoreceptor having a polymeric complex exhibiting a charge generation function and a charge transport function, and so forth.

The layer constitution of the organic photoreceptor in the present invention are exemplified as shown below.

(1) A charge generation layer and a charge transport layer are provided in order as the photosensitive layer on a conductive support;

(2) A charge generation layer, a first charge transport layer and a second charge transport layer are provided in order as the photosensitive layer on a conductive support; and (3) A surface protective layer is further provided on the photosensitive layer in each photoreceptor of the above-described (1) and (2).

The photoreceptor may be allowed to have any of the above-described constitutions. Further, a subbing layer (intermediate layer) may be formed before forming a photosensitive layer on a conductive support, even though the photoreceptor has any of the constitutions.

The charge transport layer means a layer having a function by which a charge carrier generated in a charge generation layer via exposure to light is transported to the surface of an organic photosensitive layer, and the detected charge transporting function can be confirmed by detecting photoconductivity after the charge generation layer and the charge transport layer are layered on the conductive substrate.

The layer constitution of the organic photoreceptor will be described below, mainly referring to the above-described (1).

Conductive Support

A conductive support used for a photoreceptor may be any of a sheet-shaped conductive support and a cylindrical conductive support, but the cylindrical conductive support is preferable in view of designing of a compact size image forming apparatus.

The cylindrical conductive support means a cylindrical support to form images endlessly via rotation thereof, and a conductive support having a straightness of not more than 0.1 mm and a swinging of not more than 0.1 mm is preferable. In the case of the straightness and the swinging not falling within this range, excellent images are difficult to be formed.

Usable are a metal drum made of aluminum, nickel or the like as a conductive material, a plastic drum on which aluminum, tin oxide, indium oxide or the like is evaporated, a paper or plastic drum on which a conductive material is coated. A conductive support having a specific resistance of not more than $10^3$ Ωcm at room temperature is preferable. An aluminum support is most preferable as a conductive support of the present invention. One mixed with components such as manganese, zinc, magnesium and so forth other than aluminum as a main component are also employed for the aluminum substrate.

Intermediate Layer

In the present invention, an intermediate layer is preferably provided between a conductive support and a photosensitive layer.

The intermediate layer to be used in the present invention preferably contains N-type semiconductor particles. The N-type semiconductor particles mean particles in which the charge carrier is mainly an electron. That is, since the charge carrier is mainly is an electron, the intermediate layer in which the N-type semiconductor particles are contained in an insulation binder blocks hole injection from the substrate efficiently, and exhibits less blocking against electrons from the photosensitive layer.

Titanium oxide ($TiO_2$) and zinc oxide (ZnO) are preferable as the N-type semiconductor particles, and titanium oxide to be used is particularly preferable.

Particles having a number average primary particle diameter of 3-200 nm are used as the N-type semiconductor particles. Those having a number average primary particle diameter of 5-100 nm are particularly preferable. The number average primary particle diameter is a measured value obtained by observing randomly selected 100 particles as the primary particles employing a transmission electron microscope under a magnification of 10,000 and computing their average diameter in the Feret direction via image analysis. In the case of N-type semiconductor particles having a number average primary particle diameter of less than 3.0 nm, uniform dispersion in a binder for an intermediate layer is difficult to be made, coagulated particles are easy to be formed, and residual potential is easy to be produced because the coagulated particles are acted as charge trapping. On the other hand, in the case of N-type semiconductor particles having a number average primary particle diameter exceeding 200 nm, and a large roughened surface is easy to be formed on the surface of the intermediate layer, whereby dot images are easy to be degraded because of the large roughened surface. In addition, the N-type semiconductor particles having a number average primary particle diameter exceeding 200 nm are easy to be precipitated in the dispersion, and coagulated products are easy to be produced, whereby dot images are easily degraded.

The crystalline type of the titanium oxide particle includes an anatase type, a rutile type, a brookite type, an amorphous type and so forth. Among them, a rutile type titanium oxide pigment or an anatase type titanium oxide pigment is most preferable as the N-type semiconductor particle of the present invention since rectification of the charge passing through the intermediate layer is raised, that is, electron mobility is raised, electrification potential is stabilized, and increase of the residual potential is inhibited, whereby degradation of dot images can be avoided.

The N-type semiconductor particles are preferably those subjected to a surface treatment with a polymer containing a methylhydrogen siloxane unit. The surface treatment is highly effective with a polymer containing the methylhydrogen siloxane unit, which has a molecular weight of 1,000-20,000, whereby semiconductor particles are raised, generation of black spots is inhibited when an intermediate layer containing the N-type semiconductor particles, and excellent dot images are effectively reproduced.

The polymer containing a methylhydrogen siloxane unit is preferably a copolymer of a structural unit of —(HSi($CH_3$)O)— and another structural unit (another siloxane unit). Preferable examples of the other siloxane unit include a dimethylsiloxane unit, a methylethylsiloxane unit, a methylphenylsiloxane unit, a diethylsiloxane unit and so forth, and dimethylsiloxane is particularly preferable. The ratio of the methylhydrogen siloxane unit in the copolymer is 10-99 mol % and preferably 20-90 mol %.

The methylhydrogen siloxane copolymer may be any of a random copolymer, a block copolymer and a graft copolymer, but the random copolymer and the block copolymer are preferable. In addition, the copolymer component other than the methylhydrogen siloxane may be allowed to be a single component, or to be at least two components.

An intermediate layer coating solution prepared to form an intermediate layer of the present invention is composed of a binder resin and a dispersing solvent other than N-type semiconductor particles such as those made of titanium oxide subjected to the foregoing surface treatment.

The ratio of the N-type semiconductor particles in the intermediate layer is preferably 1.0-2.0 times on terms of a volume ratio with respect to a binder resin in the intermediate layer (provided that volume of the binder resin is set to 1). When the N-type semiconductor particles are used at such the high density in the intermediate layer, rectification of the intermediate layer is raised, and increase of residual potential and degradation of dot images can be effectively inhibited even though a thicker layer is prepared, whereby an excellent organic photoreceptor can be formed. In addition, 100-200 parts by volume of N-type semiconductor particles are preferably used for such the intermediate layer with respect to 100 parts by volume of a binder resin.

On the other hand, as a binder resin to disperse these particles and to form a layer structure of the intermediate layer, a polyamide resin is preferable in order to obtain excellent dispersibility of particles, but the following polyamide resins are specifically preferred.

An alcohol-soluble polyamide resin is preferable as a binder resin for the intermediate layer. As the binder resin for the intermediate layer of an organic photoreceptor, a resin exhibiting high solubility in a solvent is desired in order to form an intermediate layer having uniform thickness. As such the alcohol-soluble polyamide resin, a copolymerized polyamide resin and a methoxy methylated polyamide resin which are composed of a chemical structure having few carbon chains between amide bonds such as 6-Nylon and so forth are known, but in addition to these, polyamides having the following components are also preferably usable.

N-1

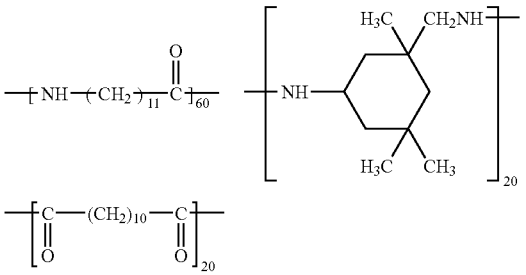

N-2

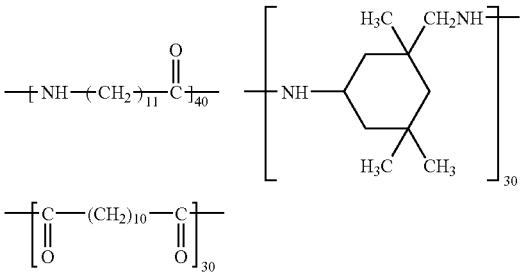

N-3

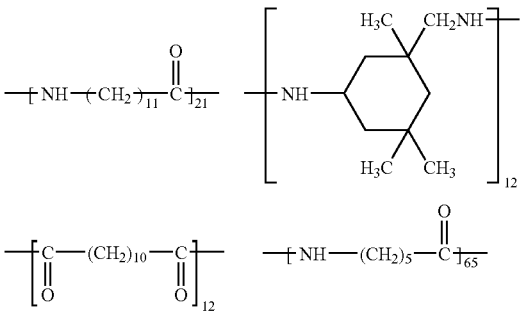

N-4

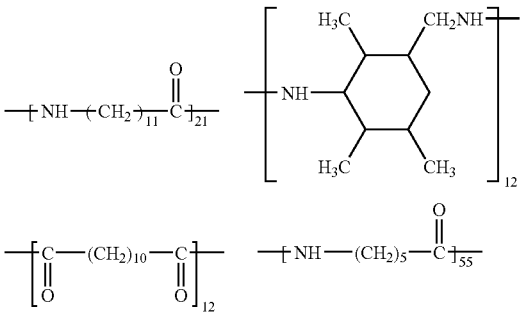

N-5

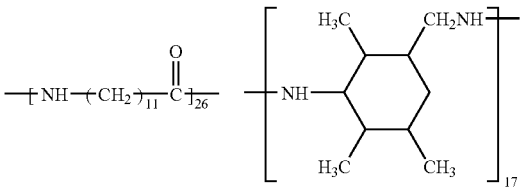

-continued

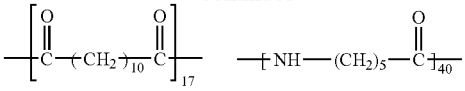

The component ratio in the polyamide N-1 to N-5 is indicated by mol %.

Further, the polyamide resin preferably has a number average molecular weight of 5,000-80,000 as a molecular weight, and more preferably has a number average molecular weight of 10,000-60,000. In the case of a number average molecular weight of 5,000 or less, thickness uniformity of the intermediate layer is deteriorated, whereby effects of the present invention are difficult to be produced. On the other hand, in the case of a number average molecular weight exceeding 80,000, solubility of a resin in a solvent tends to be lowered, and a coagulated resin is easy to be generated in an intermediate layer, whereby generation of black spots and degradation of dot images black are easy to be produced.

The polyamide resin has already been commercially available in part, and is sold under the trade name of VESTAMELT X1010, X4685 and so forth, for example, produced by Daicel-Degussa Ltd. It can be prepared by a conventional synthetic method of polyamide, but an example of the synthetic method is exemplified below, Preferable examples of the solvent to prepare a coating solution after dissolving the above-described polyamide resin include alcohols each having 2-4 carbon atoms such as ethanol, n-propyl alcohol, isopropyl alcohol, n-butanol, t-butanol, sec-butanol and so forth, and these are excellent in view of solubility of polyamide and coatability of the resulting coating solution. The solvent in the total solvent has a content of 30-100% by weight, preferably has a content of 40-100% by weight, and more preferably has a content of 50-100% by weight. Examples of the auxiliary solvent with which a preferable effect is produced by using the foregoing solvent in combination include methanol, benzyl alcohol, toluene, methylene chloride, cyclohexanone, tetrahydrofuran and so forth.

The intermediate layer of the present invention preferably has a thickness of 0.3-10 μm. In the case of the intermediate layer having a thickness of less than 0.5 μm, black spots are easy to be generated, and dot images tend to be degraded. In the case of the intermediate layer having a thickness exceeding 10 μm, residual potential is easily raised, and dot images tend to be degraded. The intermediate layer more preferably has a thickness of 0.5-5 μm.

The intermediate layer is desired substantially to be an insulating layer. Herein, the insulating layer means a layer having a volume resistance of at least $1\times10^{8}$ Ω·cm. Each of the intermediate layer and the protective layer in the present invention preferably has a volume resistance of $1\times10^{8}$-$1\times10^{15}$ Ω·cm, more preferably has a volume resistance of $1\times10^{9}$-$1\times10^{14}$ Ω·cm, and still more preferably has a volume resistance of $2\times10^{9}$-$1\times10^{13}$ Ω·cm. The volume resistance can be measured as described below.

Measuring condition: in accordance with JIS C2318-1975

Measuring apparatus: Hiresta IP manufactured by Mitsubishi Chemical Corporation.

Measuring condition: Measuring probe HRS

Applied voltage: 500 V

Measuring environment: 30±2° C., 80±5 RH %

In the case of a volume resistance of less than $1\times10^{8}$ Ω·cm, blocking ability of the intermediate layer is lowered, generation of black spots is increased, and a potential keeping property of an organic photoreceptor is degraded, whereby no excellent image quality can be obtained. On the other hand, in the case of a volume resistance exceeding $1\times10^{15}$ Ω·cm, residual potential obtained via repetitive image formation tends to be increased, whereby no excellent image quality can be obtained.

Photosensitive Layer

The photosensitive layer constitution of a photoreceptor in the present invention may be a structure of a photosensitive layer composed of a single layer, exhibiting a charge generation function and a charge transport function, provided on the foregoing intermediate layer, but the constitution in which functions of the photosensitive layer are separated into charge generation layer (CGL) and charge transport layer (CTL) is more preferred. Increase of residual potential caused by repetitive use can be minimized via control by using the constitution to separate the functions, whereby electrophotographic characteristics along the purpose are easy to be controlled. In the case of a photoreceptor for negative electrification, it is preferable that charge generation layer (CGL) is provided on an intermediate layer, and charge transport layer (CTL) is provided thereon.

The constitution of a photosensitive layer in a function-separating negative electrification photoreceptor will now be described below.

Charge Generation Layer

The organic photoreceptor of the present invention contains a compound represented by foregoing Formula (1) as a charge generation material. Some other charge generation materials other than this charge generation material may be used in combination. Examples of the pigment used in combination include a phthalocyanine pigment, an azo pigment, a perylene pigment, a polycyclic quinone pigment and so forth.

A binder is desired in a charge generation layer as a dispersing solvent for charge generation material (CGM). A commonly known resin is usable as the binder, but a formal resin, a butyral resin, a silicone resin, a silicone-modified butyral resin, a phenoxy resin and so forth are provided as the most preferable resin. As to a ratio of the charge generation material to the binder resin, preferable are 20-600 parts by weight of the charge generation material with respect to 100 parts by weight of the binder resin. Increase of residual potential caused by repetitive use can minimized by using such the resin. The charge generation layer preferably has a thickness of 0.3-2 μm.

Charge Transport Layer

In the present invention, the charge transport layer may be composed of a single layer, or of a plurality of layers.

The charge transport layer contains charge transport material (CTM) and a binder resin for dispersing CTM to conduct film formation. Additives such as an antioxidant and so forth may be contained as the other material, if desired.

Hole transport type (P-type) charge transport material (CTM) can be used as charge transport material (CTM). Usable examples thereof include a triphenylamine derivative, a hydrazone compound, a styryl compound, a benzidine compound, a butadiene compound and so forth. Among them, a charge transport material exhibiting no absorption in a wavelength of 400-500 nm, represented by the following Formula (3) is preferable.

Formula (3)

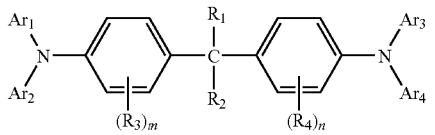

In Formula (3), each of $R_1$ and $R_2$ independently represents an alkyl group or an aryl group, and a cyclic structure may be formed under the integration of $R_1$ and $R_2$. Each of $R_3$ and $R_4$ independently represents a hydrogen atom, an alkyl group or an aryl group, and each of $Ar_1$-$Ar_4$ represents a substituted aryl group or an unsubstituted aryl group. Each of $Ar_1$-$Ar_4$ may be identical or different. A cyclic structure may also be formed by bonding $Ar_1$ to $Ar_2$ as well as bonding $Ar_3$ to $Ar_4$. Each of m and n is an integer of 1-4. Specific examples of the compound represented by foregoing Formula (3) are shown below.

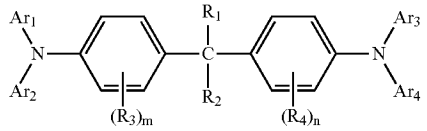
| CTM-No. | $Ar_1$ | $Ar_3$ | $Ar_2$ | $Ar_4$ | $R_1$ | $R_2$ | 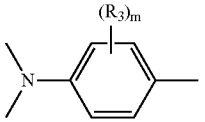 | 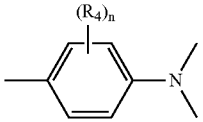 |
|---|---|---|---|---|---|---|---|---|
| CTM-1 | 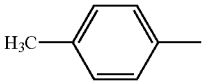 | 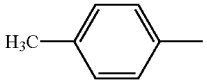 | 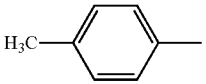 | 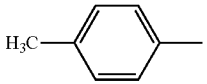 | —$CH_3$ | —$CH_3$ | 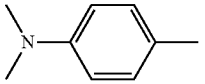 | 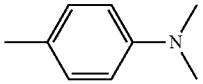 |
| CTM-2 | 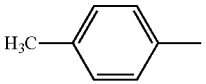 | 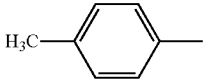 | 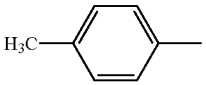 | 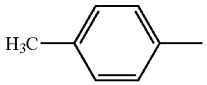 | —$CH_3$ | —$C_2H_5$ | 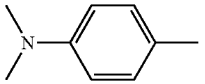 | 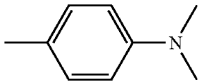 |
| CTM-3 | 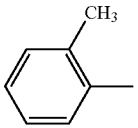 | 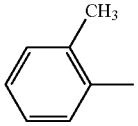 | 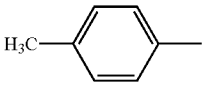 | 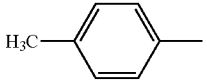 | —$CH_3$ | —$C_3H_7$(l) | 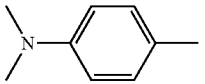 | 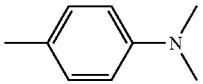 |
| CTM-4 | 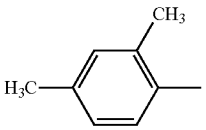 | 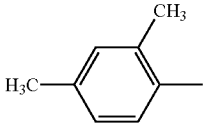 | 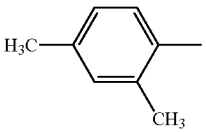 | 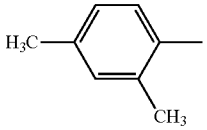 | —$CH_3$ | —$C_4H_9$(n) | 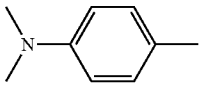 | 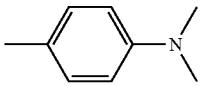 |
| CTM-5 | 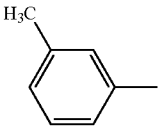 | 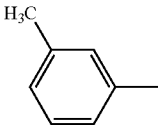 | 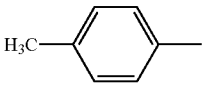 | 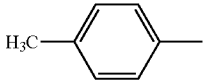 | —$CH_3$ | 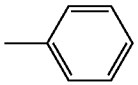 | 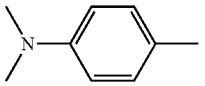 | 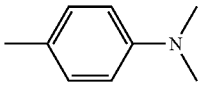 |
| CTM-6 | 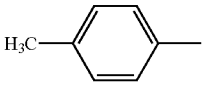 | 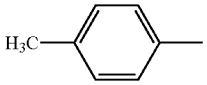 | 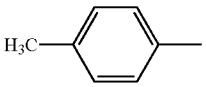 | 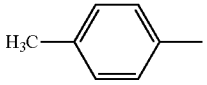 | | 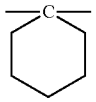 | 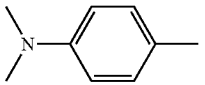 | 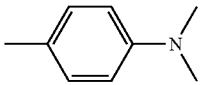 |

-continued
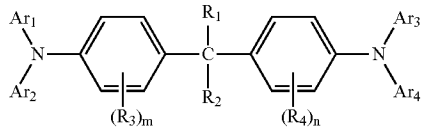
| CTM-No. | $Ar_1$ | $Ar_3$ | $Ar_2$ | $Ar_4$ | $R_1$ | $R_2$ | 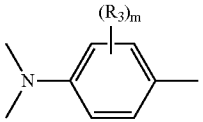 | 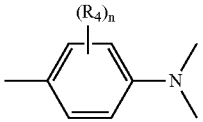 |
|---|---|---|---|---|---|---|---|---|
| CTM-7 | 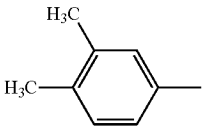 | 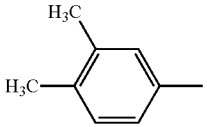 | 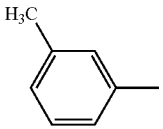 | 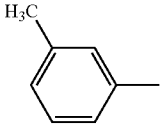 | —$CH_3$ | —$CH_3$ | 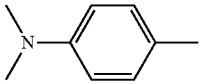 | 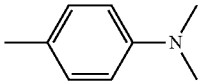 |
| CTM-8 | 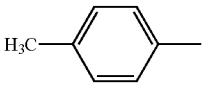 | 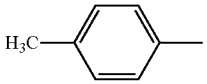 | 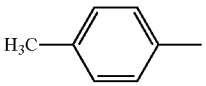 | 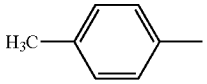 | —H | —H | 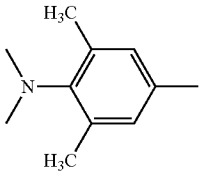 | 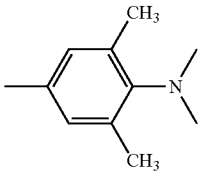 |
| CTM-9 | 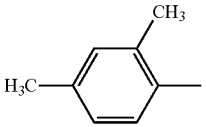 | 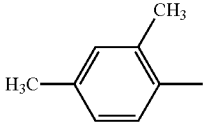 | 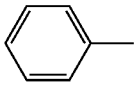 | 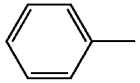 | —$CH_3$ | —$CH_3$ | 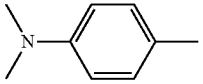 | 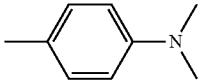 |
| CTM-10 | 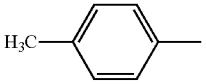 | 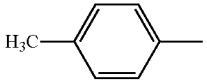 | 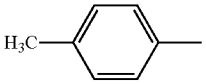 | 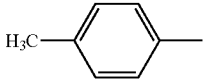 | 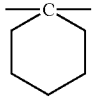 | | 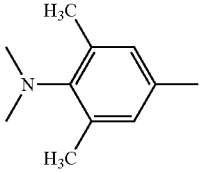 | 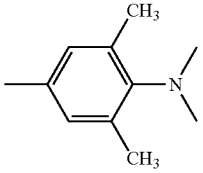 |

-continued
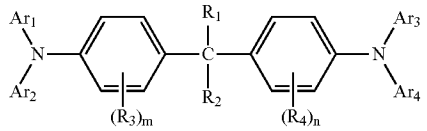
| CTM-No. | $Ar_1$ | $Ar_3$ | $Ar_2$ | $Ar_4$ | $R_1$ | $R_2$ | 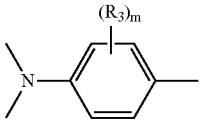 | 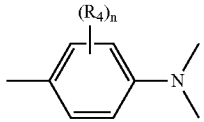 |
|---|---|---|---|---|---|---|---|---|
| CTM-11 | 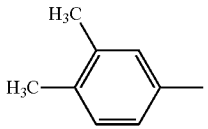 | 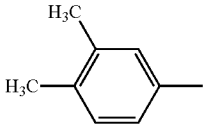 | 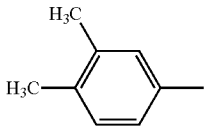 | 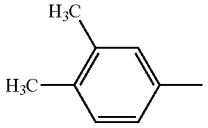 | | 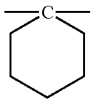 | 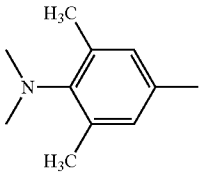 | 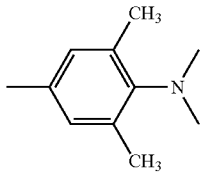 |
| CTM-12 | 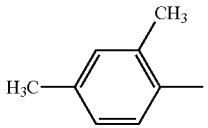 | 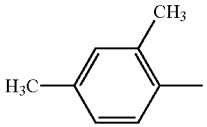 | 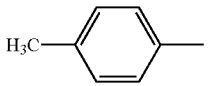 | 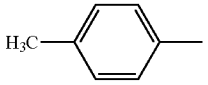 | | 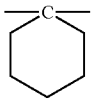 | 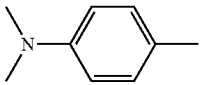 | 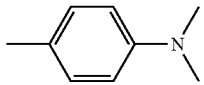 |
| CTM-13 | 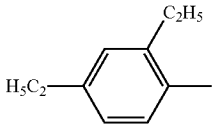 | 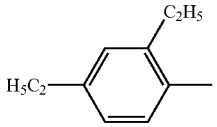 | 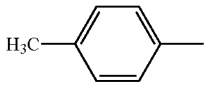 | 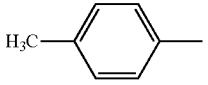 | | 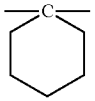 | 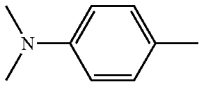 | 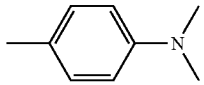 |
| CTM-14 | 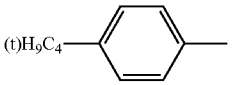 | 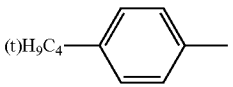 | 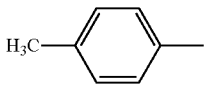 | 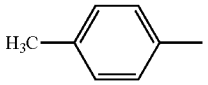 | | 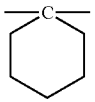 | 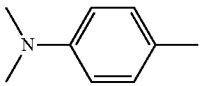 | 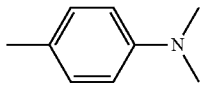 |
| CTM-15 | 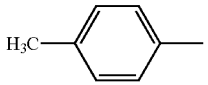 | 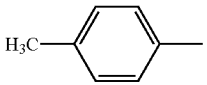 | 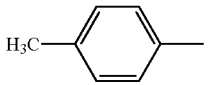 | 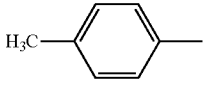 | $-C_2H_5$ | $-C_2H_5$ | 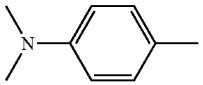 | 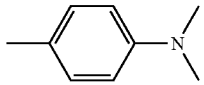 |

SYNTHETIC EXAMPLE 4 (CTM-6)

SYNTHETIC EXAMPLE 1

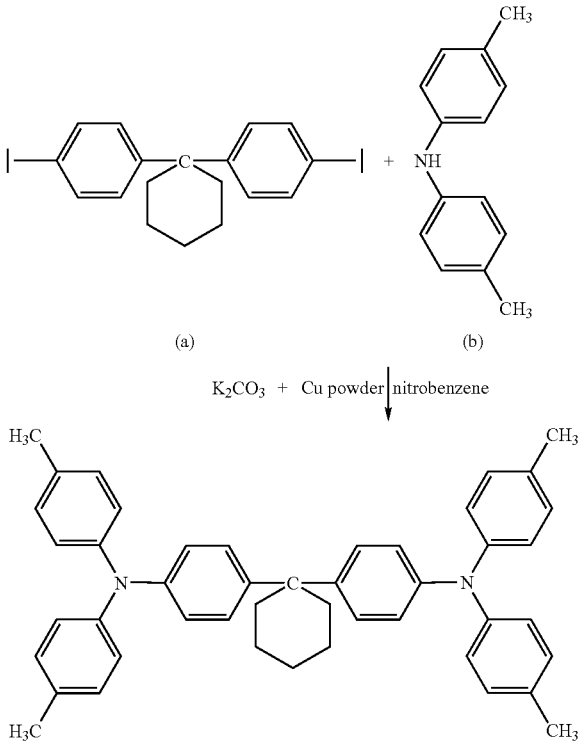

CTM-6

A magnetic stirrer is arranged to be set with a 200 ml four-necked flask fitted with a condenser tube, a thermometer and a nitrogen gas introducing tube. The inside of this system is depressurized to conduct nitrogen replacement completely. Into this flask, charged were 8.1 g of (a), 12.0 g of (b), 16 g of $K_2O_3$, 8.0 g of Cu powder and 40 ml of nitrobenzene in order to conduct reaction at 190° C. for 30 hours while stirring. After treating the above-described reaction solution via steam distillation, separation and refinement of the resulting were conducted via column chromatography employing a developing solvent of hexane/toluene (4/1) to obtain 12 g of CTM-6 as an object. This object was checked via mass analysis and NMR.

The charge transport material is usually dissolved in an appropriate binder resin to conduct layer formation. A binder resin to be used for charge transport layer (CTL) may be any of a thermoplastic resin and a thermosetting resin. Examples thereof include polystyrene, an acrylic resin, a methacrylic resin, a vinyl chloride resin, a vinyl acetate resin, a polyvinyl butyral resin, an epoxy resin, a polyurethane resin, a phenol resin, a polyester resin, an alkyd resin, a polycarbonate resin, a silicone resin, a melamine resin and a copolymer having at least two repeating units of the above-described resins. Further, an organic polymer semiconductor such as poly-N-vinylcarbazole or the like other than these insulating resins is provided. Among them, most preferable is a polycarbonate resin exhibiting small water absorption coefficient and excellent dispersibility of CTM together with excellent electrophotographic properties.

As to a ratio of the charge transport material to the binder resin, preferable is 50-200 parts by weight of the charge transport material with respect to 100 parts by weight of the binder resin.

The charge transport layer preferably has a thickness of 10-30 μm. In the case of a total thickness of less than 10 μm, sufficient latent image potential during developing is difficult to be obtained, and lowering of image density and degradation are easy to be generated. On the other hand, in the case of a total thickness exceeding 30 μm, diffusion of a charge carrier (diffusion of the charge carrier generated in a charge generation layer) is increased, whereby dot reproduction tends to be degraded. Further, in cases where the charge transport layer composed of a plurality of layers is formed, the charge transport layer as a surface layer preferably has a thickness of 1.0-8.0 μm.

Examples of the solvent or dispersing solvent utilized for layer formation of a charge generation layer and s charge transport layer include n-Butylamine, diethylamine, ethylenediamine, isopropanolamine, triethanolamine, triethylenediamine, N,N-dimethylformamide, acetone, methyl ethyl ketone, methylisopropyl ketone, cyclohexane, benzene, toluene, xylene, chloroform, dichloromethane, 1,2-dichloroethane, 1,2-dichloropropane, 1,1,2-trichloroethane, 1,1,1-trichloroethane, trichloroethylene, tetrachloroethane, tetrahydrofuran, dioxolan, dioxane, methanol, ethanol, butanol, isopropanol, ethyl acetate, butyl acetate, dimethylsulfoxide, methyl cellosolve and so forth. The present invention is not limited thereto, but preferably usable are solvents producing less influence to human bodies and ecosystems such as tetrahydrofuran, methylethyl ketone and so forth. In addition, these solvents can be used singly or in combination of at least two kinds of mixed solvents.

Next, as a coating method to prepare an organic photoreceptor, a coating method such as a dipping coating method, a spray coating method or the like other than a method with a slide hopper type coating apparatus is employed.

A coating method employing a slide hopper type coating apparatus among the above-described coating solution supplying type coating apparatuses is most suitable for the occasion to use a dispersion in which a low-boiling point solvent is used, as a coating solution, and in the case of a cylindrical photoreceptor, it is preferable to conduct coating by using a circular slide hopper type coating apparatus described in detail in Japanese Patent O.P.I. Publication No. 58-189061.

An antioxidant is preferably contained in a surface layer of the photoreceptor in the present invention. The surface layer is easy to be oxidized by reactive gas such as NO, ozone and so forth during electrification of the photoreceptor, and blurring of images tends to be generated, but generation of blurring of images can be inhibited via coexistence of the antioxidant. The antioxidant is a substance as a typical one exhibiting a property by which action of oxygen is controlled or inhibited under the condition of light, heat, discharge or the like, with respect to an auto-oxidizing substance existing in the photoreceptor or on the surface of the photoreceptor.

Examples of the solvent or dispersing solvent utilized for layer formation of a charge generation layer and s charge transport layer include n-Butylamine, diethylamine, ethylenediamine, isopropanolamine, triethanolamine, triethylenediamine, N,N-dimethylformamide, acetone, methyl ethyl ketone, methylisopropyl ketone, cyclohexane, benzene, toluene, xylene, chloroform, dichloromethane, 1,2-dichloroethane, 1,2-dichloropropane, 1,1,2-trichloroethane, 1,1,1-trichloroethane, trichloroethylene, tetrachloroethane, tetrahydrofuran, dioxolan, dioxane, methanol, ethanol, butanol, isopropanol, ethyl acetate, butyl acetate, dimethylsulfoxide, methyl cellosolve and so forth. The present invention is not limited thereto, but preferably usable are dichloromethane, 1,2-dichloroethane, methylethyl ketone and so forth. In addition, these solvents can be used singly or in combination of at least two kinds of mixed solvents.

Next, An image forming apparatus fitted with an organic photoreceptor of the present invention will now be described.

Image forming apparatus 1 shown in FIG. 1 is a digital image forming apparatus. It possesses image reading section A, image processing section B, image forming section C, and transfer paper conveyance section D as a transfer paper conveyance device.

An automatic document feed device for automatically feeding documents is arranged on the top of image reading section A. The documents placed on document platen 11 as conveyed sheet by sheet employing document conveying roller 12, and the image is read at reading position 13*a*. The document having been read is ejected onto document ejection tray 14 by document conveying roller 12.

In the meantime, the image of the document placed on plate glass 13 is read by reading operation at speed v by first mirror unit 15 having an illumination lamp constituting a scanning optical system and a first mirror, and by the movement of second mirror unit 16 having the second and third mirrors located at the V-shaped position at speed v/2 in the same direction.

The scanned images are formed on the light receiving surface of image-capturing device (CCD) as a line sensor through projection lens 17. The linear optical images formed on image-capturing device (CCD) are sequentially subjected to photoelectric conversion into electric signals (luminance signals). Then they are subjected to analog-to-digital conversion, and then to such processing as density conversion and filtering in image processing section B. After that, image data is stored in the memory.

Image forming section C as an image forming unit posesses drum-formed photoreceptor 21 as an image carrier; charging device (charging process) 22 for charging photoreceptor 21 on the outer periphery; potential detecting device 220 for detecting the potential on the surface of the charged photoreceptor; developing device (developing process) 23; transfer conveyance belt apparatus 45 as a transfer section (transfer process); cleaning device (cleaning process) 26 for photoreceptor 21; and PCL (pre-charge lamp) 27 as an optical discharging section (optical discharging process). These components are arranged in the order of operations. Further, reflected density detecting section 222 for measuring the reflected density of the patch image developed on photoreceptor 21 is provided downstream from developing device 23. A photoreceptor of the present invention is used as photoreceptor 21, and is driven in the clockwise direction as illustrated.

Rotating photoreceptor 21 is electrically charged uniformly by charging device 22. After that, image exposure is performed based on the image signal called up from the memory of image processing section B by the exposure optical system as image exposure section (image exposure process) 30. In the exposure optical system as image exposure section 30 (also known as writing section), the optical path is bent by reflection mirror 32 through rotating polygon mirror 31, fO lens 34, and cylindrical lens 35, using the laser diode (not illustrated) as a light emitting source, whereby main scanning is performed. Exposure is carried out at position Ao with reference to photoreceptor 21, and an electrostatic latent image is formed by the rotation (sub-scanning) of photoreceptor 21.

In the image forming apparatus of the present invention, when an electrostatic latent image is formed on the photoreceptor, a semiconductor laser having an emission wavelength of 350-500 nm, or a light emitting diode can be employed as an image exposure light source. By narrowing a light exposure dot diameter in the writing main scanning direction to the range of 10-50 μm employing the above image exposure light source, and by conducting a digital exposure on an organic photoreceptor, it is possible to obtain an electro-photographic image having a high resolution of 600-2500 dpi (dpi: the number of dots per 25.4 cm).

As an image exposure light source of the above-described semiconductor laser, a surface light-emitting laser array is also usable. The surface light-emitting laser array is one having at least three laser beam luminous points (L) vertically and horizontally each.

The foregoing exposure light dot diameter means a length of the exposure beam along with the main scanning direction in the area where the intensity of this exposure beam corresponds to $1/e^2$ of the peak light intensity (Ld: measured at the maximum length position).

The exposure beam to be used includes the beams of the scanning optical system using the semiconductor laser and solid scanner such as an LED and the like. The distribution of the light intensity includes Gauss distribution and Lorenz distribution. The portion exceeding $1/e^2$ of each peak intensity is assumed as an exposure light dot diameter of the present invention.

The electrostatic latent image on photoreceptor 21 is subject to reverse development by developing device 23, and a visible toner image is formed on the surface of photoreceptor 21. According to the image forming method of the present invention, polymerized toner is utilized as the developer for this developing device. An electrophotographic image exhibiting excellent sharpness can be achieved when the polymerized toner having a uniform shape and particle size is used in combination with the photoreceptor of the present invention.

The electrostatic latent image formed on the photoreceptor of the present invention is visualized as a toner image via development. The toner to be used for the development may be crushed toner or polymerized toner, but the toner of the present invention is preferably a polymerized toner prepared by a polymerization method from the viewpoint of realization of a stable particle size distribution.

The polymerized toner means a toner formed via preparation of a binder resin for the toner, polymerization of a raw material monomer for the binder resin to be of toner shape, and a subsequent chemical treatment, if desired. To be more concrete, the foregoing toner means a toner formed via polymerization reaction such as suspension polymerization, emulsion polymerization or the like, and a particle-to-particle fusing process subsequently carried out, if desired.

In addition, the volume average particle diameter, that is, 50% volume particle diameter (Dv50) is preferably 2-9 μm, and more preferably 3-7 μm. High resolution can be obtained by falling the volume average particle diameter in this range. Further, an existing amount of toner having a fine particle diameter can be reduced in combination with the above-described range, though the toner is one having a small particle diameter, whereby improved dot image reproduction is obtained for a long duration, and stable images exhibiting excellent sensitivity can be formed.

The toner of the present invention may be used as a single component developer or a two-component developer.

When the toner is used as a single component developer, provided is a nonmagnetic single component developer, or a magnetic single component developer containing magnetic particles of approximately 0.1-0.5 μm in size in the toner, and both the nonmagnetic single component developer and the magnetic single component developer are usable.

The toner may be used as a two-component developer by mixing with a carrier. In this case, commonly known materials which are metal such as iron, ferrite, magnetite or the like, an alloy of such the metal and another metal such as aluminum, lead or the like, and so forth are usable as magnetic particles for carrier. Ferrite is specifically preferred. The above-described magnetic particles may preferably have a volume average particle diameter of 15-100 μm, and more preferably have a volume average particle diameter of 25-80 μm.

The volume average particle diameter of carrier can be measured typically by a laser diffraction particle size distribution measuring apparatus equipped with a wet type disperser (HELOS, manufactured by SYMPATEC Corp.).

The carrier is preferably a carrier in which a magnetic particle is coated with a resin, or a so-called resin dispersion type carrier in which a magnetic particle is dispersed in a resin. The resin composition for coating is not specifically limited, but usable examples thereof include an olefin based resin, a styrene based resin, a styrene-acryl based resin, a silicone based resin, an ester based resin, a fluorine-containing polymer based resin and so forth. The resin to prepare the resin dispersion type carrier is not specifically limited, but commonly known resins are usable. Examples thereof include a styrene-acryl based resin, a polyester resin, a fluorine based resin, a phenyl resin and so forth.

In transfer paper conveyance section D, sheet feed units 41(A), 41(B) and 41(C) as a transfer sheet storage device are arranged below the image forming unit, wherein transfer sheets P having different sizes are stored. A manual sheet feed unit 42 for manual feed of the sheets of paper is provided on the side. Transfer sheets P selected by either of the two are fed along sheet conveyance path 40 by guide roller 43, and are temporarily suspended by sheet feed registration roller 44 for correcting the inclination and deviation of transfer sheets P. Then transfer sheets P are again fed and guided by sheet conveyance path 40, pre-transfer roller 43*a*, paper feed path 46 and entry guide plate 47. The toner image on photoreceptor 21 is transferred to transfer sheet P at transfer position Bo by transfer electrode 24 and separator electrode 25, while being carried by transfer conveyance belt 454 of transfer conveyance belt apparatus 45. Transfer sheet P is separated from the surface of photoreceptor 21 by separation claw unit 250 and is brought to fixing apparatus 50 as a fixing device by transfer conveyance belt apparatus 45.

Fixing device 50 is equipped with fixing roller 51 and pressure roller 52. When transfer sheet P passes between fixing roller 51 and pressure roller 52, toner is fixed in position by heat and pressure. With the toner image having been fixed thereon, transfer sheet P is ejected onto ejection tray 64.

The above description indicates the case where an image is formed on one side of the transfer sheet. In the case of duplex copying, paper sheet ejection switching member 170 is switched and transfer sheet guide 177 is opened. Transfer sheet P is fed in the direction of an arrow shown in a broken line.

Further, transfer sheet P is fed downward by conveyance device 178 and is switched back by sheet reversing section 179. With the trailing edge of transfer sheet P becoming the leading edge, transfer sheet P is conveyed into sheet feed unit 130 for duplex copying.

Conveyance guide 131 provided on sheet feed unit 130 for duplex-copying is moved in the direction of sheet feed by transfer sheet P. Then transfer sheet P is fed again by sheet feed roller 132 and is led to sheet conveyance path 40.

As described above, transfer sheet P is again fed in the direction of photoreceptor 21, and the toner image is transferred on the reverse side of transfer sheet P. After the image has been fixed by fixing section 50, transfer sheet P is ejected to ejection tray 64 through roller pair 63.

The image forming apparatus of the present invention can be configured in such a way that the components such as the foregoing photoreceptor, developing device and cleaning device are integrally combined into a process cartridge, and this unit is mounted on the apparatus proper as a removable unit. It is also possible to arrange such a configuration that at least one of the charging device, image exposure device, developing device, transfer electrode, separator electrode and cleaning device is supported integrally with the photoreceptor, so as to form a process cartridge that, as a removable single unit, is mounted on the apparatus proper, employing a guide device such as a rail of the apparatus main body.

Figure 2:
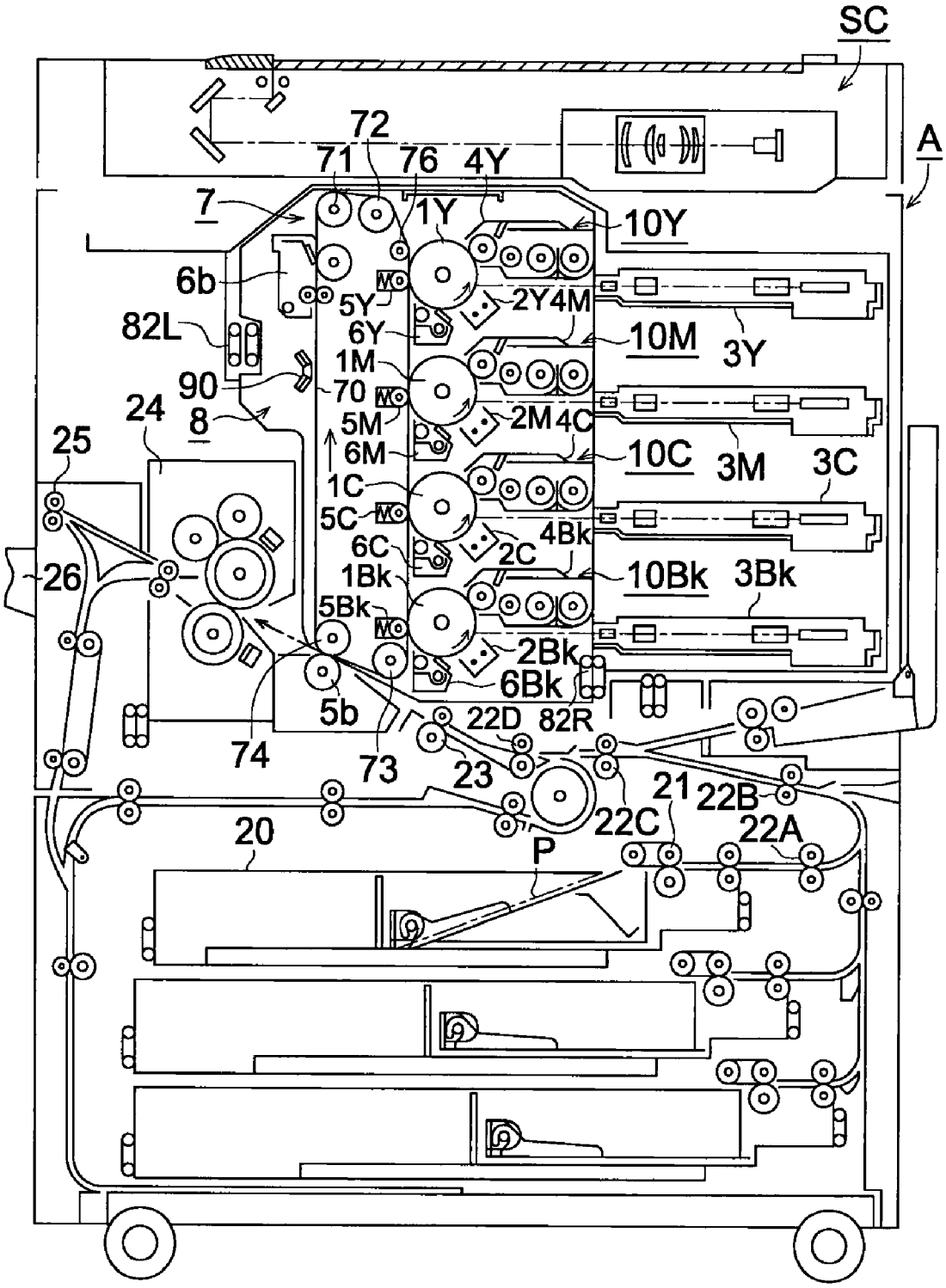
FIG. 2 is a cross-sectional configuration diagram of a color image forming apparatus in an embodiment of the present invention.

FIG. 2 is a cross-sectional schematic diagram showing a color image forming apparatus as an embodiment in the present invention.

This color image forming apparatus is called the so-called tandem type color image forming apparatus, and comprises four sets of image forming sections (image forming units) 10Y, 10M, 10C, and 10Bk, endless belt shaped intermediate transfer member unit 7, sheet feeding and conveyance device 21, and fixing device 24. The original document reading apparatus SC is placed on top of main unit A of the image forming apparatus.

Image forming section 10Y that forms images of yellow color comprises charging device (charging process) 2Y, exposure device (exposure process) 3Y, developing device (developing process) 4Y, primary transfer roller 5Y as primary transfer section (primary transfer process), and cleaning device 6Y all placed around drum-formed photoreceptor 1Y which acts as the first image supporting body. Image forming section 10M that forms images of magenta color comprises drum-formed photoreceptor 1M which acts as the first image supporting body, charging device 2M, exposure device 3M, developing device 4M, primary transfer roller 5M as a primary transfer section, and cleaning device 6M. Image forming section 10C that forms images of cyan color comprises drum-formed photoreceptor 1C which acts as the first image supporting body, charging device 2C, exposure device 3C, developing device 4C, primary transfer roller 5C as a primary transfer section, and cleaning device 6C. Image forming section 10Bk that forms images of black color comprises drum-formed photoreceptor 1Bk which acts as the first image supporting body, charging device 2Bk, exposure device 3Bk, developing device 4Bk, primary transfer roller 5Bk as a primary transfer section, and cleaning device 6Bk.

Four sets of image forming units 10Y, 10M, 10C, and 10Bk are constituted, centering on photoreceptor drums 1Y, 1M, 1C, and 1Bk, by rotating charging devices 2Y, 2M, 2C, and 2Bk, image exposure devices 3Y, 3M, 3C, and 3Bk, rotating developing devices 4Y, 4M, 4C, and 4Bk, and cleaning devices 5Y, 5M, 5C, and 5Bk that clean photoreceptor drums 1Y, 1M, 1C, and 1Bk.

Image forming units 10Y, 10M, 10C, and 10Bk, all have the same configuration excepting that the color of the toner image formed in each unit is different on respective photoreceptor drums 1Y, 1M, 1C, and 1Bk, and detailed description is given below taking the example of image forming unit 10Y.

Image forming unit 10Y has, placed around photoreceptor drum 1Y which is the image forming body, charging device 2Y (hereinafter referred to merely as charging unit 2Y or charger 2Y), exposure device 3Y, developing device 4Y, and cleaning device 5Y (hereinafter referred to simply as cleaning device 5Y or as cleaning blade 5Y), and forms yellow (Y) colored toner image on photoreceptor drum 1Y. Further, in the present preferred embodiment, at least photoreceptor drum 1Y, charging device 2Y, developing device 4Y, and cleaning device 5Y in image forming unit 10Y are provided in an integral manner.

Charging device 2Y is a device that applies a uniform electrostatic potential to photoreceptor drum 1Y, and corona discharge type charger unit 2Y is being used for photoreceptor drum 1Y in the present preferred embodiment.

Image exposure device 3Y is a device that carries out light exposure, based on an image signal (Yellow), on photoreceptor drum 1Y to which a uniform potential has been applied by charging device 2Y, and that forms an electrostatic latent image corresponding to the yellow color image, and as for exposure device 3Y, a semiconductor laser having an emission wavelength of 350-500 nm or a light-emitting diode as described in the foregoing FIG. 1 is usable as an image exposure light source. By narrowing a light exposure dot diameter in the writing main scanning direction to the range of 10-50 μm employing the above image exposure light source, and by conducting a digital exposure on an organic photoreceptor, it is possible to obtain an electro-photographic image having a high resolution of 600-2500 dpi (dpi: the number of dots per 25.4 cm). In addition, the foregoing surface light-emitting laser array is also usable. Further, also usable is one composed of LED in which light-emitting elements are arranged in the form of an array in the direction of photoreceptor drum 1Y axis, and an image focusing element (product name: Selfoc lens), or the like.

The image forming apparatus of the present invention can be configured in such a way that the constituents such as the foregoing photoreceptor, a developing device, a cleaning device and so forth are integrally combined into a process cartridge (image forming unit), and this image forming unit may be mounted on the apparatus main body as a removable unit. It is also possible to arrange such a configuration that at least one of a charging device, an image exposure device, a developing device, a transfer or separation device and a cleaning device is supported integrally with the photoreceptor, so as to form a process cartridge (image forming unit) that is mounted on the apparatus, as a removable single image forming unit, employing a guide device such as a rail of the apparatus main body.

Intermediate transfer member unit 7 in the form of an endless belt is wound around a plurality of rollers, and has endless belt shaped intermediate transfer member 70 which acts as a second image carrier in the shape of a partially conducting endless belt which is supported in a free manner to rotate.

The images of different colors formed by image forming units 10Y, 10M, 10C, and 10Bk, are successively transferred on to rotating endless belt shaped intermediate transfer member 70 by primary transfer rollers 5Y, 5M, 5C, and 5Bk acting as the primary image transfer section, thereby forming the synthesized color image. Transfer material P as the transfer material stored inside sheet feeding cassette 20 (the supporting body that carries the final fixed image: for example, plain paper, transparent sheet, etc.,) is fed from sheet feeding device 21, pass through a plurality of intermediate rollers 22A, 22B, 22C, and 22D, and resist roller 23, and is transported to secondary transfer roller 5*b* which functions as the secondary image transfer section, and the color image is transferred in one operation of secondary image transfer on to transfer material P. Transfer material P on which the color image has been transferred is subjected to fixing process by fixing device 24, and is gripped by sheet discharge rollers 25 and placed above sheet discharge tray 26 outside the equipment. Here, the transfer supporting body of the toner image formed on the photoreceptor of the intermediate transfer body or of the transfer material, etc. is comprehensively called the transfer medium.

On the other hand, after the color image is transferred to transfer material P by secondary transfer roller 5*b* functioning as the secondary transfer section, endless belt shaped intermediate transfer member 70 from which transfer material P has been separated due to different radii of curvature is cleaned by cleaning device 6*b* to remove all residual toner on it.

During image forming, primary transfer roller 5Bk is at all times contacting against photoreceptor 1Bk. Other primary transfer rollers 5Y, 5M, and 5C come into contact respectively with corresponding photoreceptors 1Y, 1M, and 1C only during color image forming.

Secondary transfer roller 5*b* comes into contact with endless belt shaped intermediate transfer body 70 only when secondary transfer is conducted with transfer material P passing through this.

Further, chassis 8 can be pulled out via supporting rails 82L and 82R from body A of the apparatus.

Chassis 8 possesses image forming sections 10Y, 10M, 10C, and 10Bk, and endless belt shaped intermediate transfer member unit 7.

Image forming sections 10Y, 10M, 10C, and 10Bk are arranged in column in the vertical direction. Endless belt shaped intermediate transfer member unit 7 is placed to the left side in the figure of photoreceptor drums 1Y, 1M, 1C, and 1Bk. Endless belt shaped intermediate transfer member unit 70 possesses endless belt shaped intermediate transfer member 70 that can rotate around rollers 71, 72, 73, and 74, primary image transfer rollers 5Y, 5M, 5C, and 5Bk, and cleaning device 6*b*.

Figure 3:
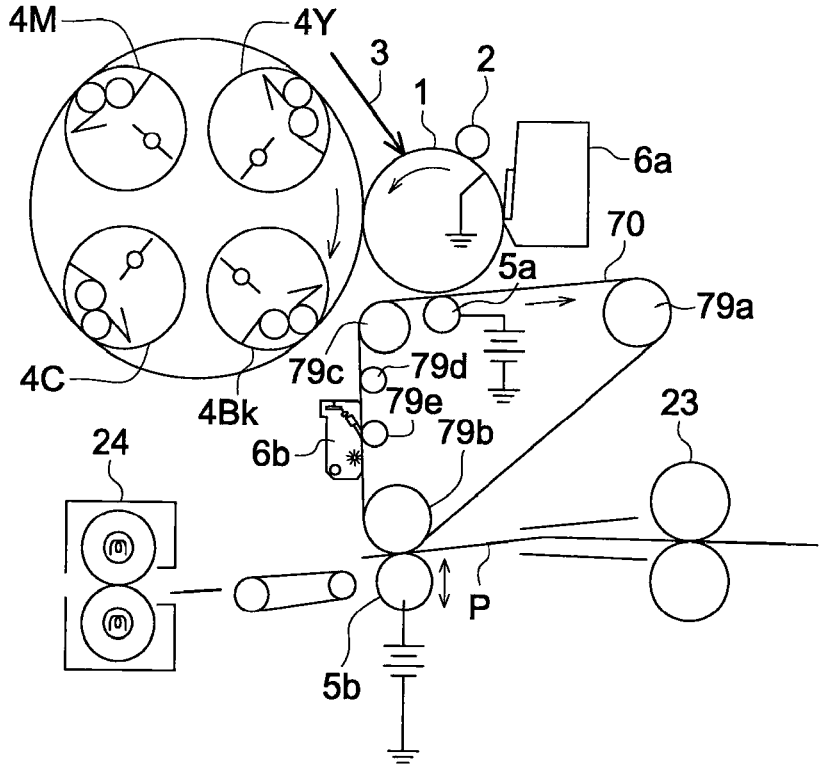
FIG. 3 is a cross-sectional configuration diagram of a color image forming apparatus fitted with an organic photoreceptor of the present invention.
Figure 4:
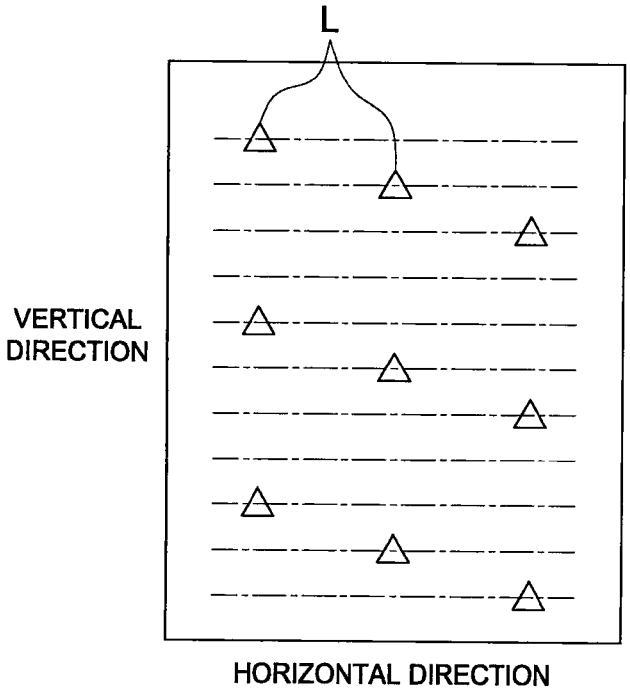
FIG. 4 is a diagram showing a frame format of a surface light-emitting array.

Next, FIG. 3 shows a cross-sectional configuration diagram of a color image forming apparatus fitted with an organic photoreceptor of the present invention (a copier or a laser beam printer possessing at least a charging device, an exposure device, a plurality of developing devices, an image transfer device, a cleaning device, and an intermediate transfer member provided around the organic photoreceptor). An elastic body with a medium level of electrical resistivity is employed for belt shaped intermediate transfer member 70.

Numeral 1 represents a rotating drum type photoreceptor that is repetitively used as the image carrying body, and is driven to rotate with a specific circumferential velocity in the anti-clockwise direction indicated by the arrow.

During rotation, photoreceptor 1 is charged uniformly to a specific polarity and potential by charging device (charging process) 2, and next, when it receives image exposure obtained via scanning exposure light with a laser beam modulated in accordance with the time-serial electrical digital pixel signal of the image information from image exposure device (image exposure process) 3 not shown in the figure, formed is an electrostatic latent image corresponding to yellow (Y) color component image (color information) as an intended color image.

Next, the electrostatic latent image is developed by yellow (Y) developing device: developing process (yellow color developing device) 4Y employing the yellow toner as the first color. In this case, the second developing device to the fourth developing device (magenta color developing device, cyan color developing device, and black color developing device) 4M, 4C, and 4Bk are each in the operation switched-off state and do not act on photoreceptor 1, and the yellow toner image of the above-described first color does not get affected by the above-described second developing device to fourth developing device.

Intermediate transfer member 70 is passed through rollers 79*a*, 79*b*, 79*c*, 79*d*, and 79*e* and is driven to rotate in a clockwise direction with the same circumferential speed as photoreceptor 1.

The yellow toner image of the first color formed and retained on photoreceptor 1 is, in the process of passing through the nip section between photoreceptor 1 and intermediate transfer member 70, intermediate-transferred (primary transferred) successively to the outer peripheral surface of intermediate transfer member 70 due to the electric field formed by the primary transfer bias voltage applied from primary transfer roller 5*a* to intermediate transfer member 70.

The surface of photoreceptor 1 after it has completed the transfer of the first color yellow toner image to intermediate transfer member 70 is cleaned by cleaning device 6*a*.

In the same manner as described above, the second color magenta toner image, the third color cyan toner image, and the fourth color black toner image are transferred successively on to intermediate transfer member 70 in a superimposing manner, thereby forming the superimposed color toner image corresponding to the intended color image.

Secondary transfer roller 5*b* is placed so that it is supported by bearings parallel to secondary transfer opposing roller 79*b* and pushes against intermediate transfer member 70 from below in a separable condition.

In order to carry out successive overlapping transfer of the toner images of the first to fourth colors from photoreceptor 1 to intermediate transfer member 70, the primary transfer bias voltage applied has a polarity opposite to that of the toner and is applied from the bias power supply. This applied voltage is, for example, in the range of +100V to +2 kV.

During the primary transfer process of transferring the first to the third color toner image from photoreceptor 1 to intermediate transfer member 70, secondary transfer roller 5*b* and intermediate transfer member cleaning device 6*b* can be separated from intermediate transfer member 70.

The transfer of the superimposed color toner image transferred onto belt shaped intermediate transfer member 70 on to transfer material P which is the second image supporting body is done when secondary transfer roller 5*b* is in contact with the belt of intermediate transfer member 70, and transfer material P is fed from corresponding sheet feeding resist roller 23 via the transfer sheet guide to the contacting nip between secondary transfer roller 5*b* and intermediate transfer member 70 at a specific timing. The secondary transfer bias voltage is applied from the bias power supply to secondary image transfer roller 5*b*. Because of this secondary transfer bias voltage, the superimposed color toner image is transferred (secondary transfer) from intermediate transfer member 70 to transfer material P which is the second image supporting body. Transfer material P which has received the transfer of the toner image is guided to fixing device 24 and is heated and fixed there.

The image forming apparatus of the present invention is commonly suitable for electrophotographic apparatuses such as electrophotographic copiers, laser printers, LED printers, liquid crystal shutter type printers and so forth. Further, the image forming apparatus can be widely utilized for apparatuses for displaying, recording, light printing, plate making and facsimile applied from an electrophotographic technique.

EXAMPLE

Next, the present invention will further be described according to EXAMPLE. In addition, "parts" and "%" in the present EXAMPLE are parts by weight and % by weight, respectively, unless otherwise specifically mentioned.

As to the following dispersion, dispersing was conducted in a circulation system while giving shear with rotating disk, beads and so forth employing a beads mill (Ultra Apex Mill equipped with a cooling water circulation system, manufactured by Kotobuki Industries Co., Ltd.) as a disperser.

<Dispersion Condition A>

The First Round of Dispersion

Compositions formed from the following materials

| | |
|---|---|
| Pigment (CGM of synthetic example or the like) | 6 parts by volume |
| Solvent {2-butanone/cyclohexane = 4/1 (volume ratio)} | 44 parts by volume |

Dispersing was conducted under the following dispersion condition.

Dispersion condition of beads; ZrO beads each having a diameter of 0.3 mm, a filling ratio of 80%, a disk peripheral speed of 3 m/sec, a liquid temperature of 10-15° C., and a real dispersing time of 180 minutes (net dispersing time with a circulation type disperser).

The Second Round of Dispersion

A solution containing the following materials was added into the dispersion of the first round by a membrane-filter (HDCII with a 100% rated filtration accuracy of 2.5 μm, manufactured by Pall Corporation) after filtration to conduct dispersing under the following condition.

| | |
|---|---|
| Polyvinylbutyral resin (S-LEC BL-S, produced by Sekisui Chemical Co., Ltd.) | 1 part by volume |
| Solvent (2-butanone/cyclohexane = 4/1 in volume ratio) | 19 parts by volume |

Dispersion condition of beads; ZrO beads each having a diameter of 0.3 mm, a filling ratio of 80%, a disk peripheral speed of 3 m/sec, a liquid temperature of 10-15° C., and a real dispersing time of 30 minutes.

The Third Round of Dispersion

The dispersion obtained in the second round of dispersion was once removed to replace beads, and dispersing was subsequently conducted under the following condition.

Dispersion condition of beads; ZrO beads each having a diameter of 0.03 mm, a filling ratio of 80%, a disk peripheral speed of 5 m/sec, a liquid temperature of 10-15° C., and a real dispersing time of 30 minutes.

The combination concerning the above-described first round to third round of dispersion is designated as dispersion condition A.

<Dispersion Condition B>

The same dispersion condition as dispersion condition A, except that real dispersion time for the first round dispersion is replaced by 150 minutes, is designated as dispersion condition B.

<Dispersion Condition C>

The same dispersion condition as dispersion condition A, except that real dispersion time for the first round dispersion is replaced by 120 minutes, and real dispersion time for the third round dispersion is replaced by 60 minutes is designated as dispersion condition C.

<Dispersion Condition D>

The same dispersion condition as dispersion condition A, except that dispersion time for the second round dispersion is replaced by 15 minutes, is designated as dispersion condition D.

<Dispersion Condition D'>

The same dispersion condition as dispersion condition A, except that real dispersion time for the second round dispersion is replaced by 60 minutes, is designated as dispersion condition D'.

<Dispersion Condition E>

The same dispersion condition as dispersion condition A, except that dispersion time for the third round dispersion is replaced by 15 minutes, is designated as dispersion condition E.

<Dispersion Condition F>

The same dispersion condition as dispersion condition A, except that real dispersion time for the first round dispersion is replaced by 60 minutes, is designated as dispersion condition F.

As shown in the following Table 1, CGM of synthetic examples 1-3 each was subjected to dispersing under any one of the above-described dispersion conditions A-F; the resulting dispersion was coated on a glass substrate and dried; and samples for measuring an average major axis length, an average aspect ratio, an aspect ratio variation coefficient and so forth were prepared to measure these values by the foregoing measuring method. The results are shown in Table 1.

TABLE 1

| | Dispersion condition | Compound No. (CGM No.) | Average major axis length (nm) | Average aspect ratio | Aspect ratio variation coefficient |
|---|---|---|---|---|---|
| Dispersion 1 | D' | 1 | 350 | 2.0 | 14 |
| Dispersion 2 | A | 1 | 350 | 2.5 | 12 |
| Dispersion 3 | B | 1 | 400 | 3.5 | 16 |
| Dispersion 4 | C | 1 | 450 | 5.0 | 8 |
| Dispersion 5 | D | 1 | 400 | 6.0 | 14 |
| Dispersion 6 | E | 1 | 400 | 3.5 | 17 |
| Dispersion 7 | F | 1 | 550 | 3.5 | 15 |
| Dispersion 8 | A | 2 | 200 | 4.0 | 10 |
| Dispersion 9 | B | 2 | 300 | 5.0 | 15 |
| Dispersion 10 | A | 3 | 450 | 3.0 | 9 |

Preparation of Photoreceptor

Photoreceptor 1 was prepared as described below.

The surface of a cylindrical aluminum support is subjected to cutting processing to prepare a conductive support having a 10 points surface roughness Rz of 0.7 μm.

<Intermediate Layer>

The following intermediate layer dispersion was diluted with the same mixture solvent by two times and filtrated by RIGIMESH filter having a nominal filtering accuracy of 5 μm, and a pressure of 50 kPa, manufactured by Nihon Pall Ltd., after standing for one night to prepare an intermediate layer coating solution.

| (Preparation of intermediate layer dispersion) | |
|---|---|
| Binder resin: (Exemplified Polyamide N-1) | 1 part (1.00 parts by volume) |
| N-type semiconductor particles: Rutile type titanium oxide A1 {a primary particle diameter of 35 nm; one subjected to a surface treatment with an amount of 5% by weight in the total weight of titanium oxide employing a copolymer of methylhydrogen siloxane and dimethyl siloxane (a mole ratio of 1:1)} | 3.5 parts (1.0 part by volume) |
| Ethanol/n-propyl alcohol/THF (= 45/20/30 in weight ratio) | 10 parts |

The above composition was mixed and dispersed with a butch system for 10 hours employing a beads mill disperser to prepare an intermediate layer dispersion.

The following intermediate layer coating solution was coated on the above-described conductive support by an immersion coating method, and dried at 120° C. for 30 minutes to form an intermediate layer having a dry thickness of 1.0 μm.

<Charge Generation Layers

The resulting dispersion 1 was used as a charge generation layer coating solution, and this coating solution was coated by an immersion coating method to form a charge generation layer having a dry thickness of 0.5 μm on the foregoing intermediate layer.

<Charge transport layer (CTL)>

| | |
|---|---|
| Charge transport material (CTM): the foregoing CTM-1 | 225 parts |
| Polycarbonate (Z300, manufactured by Mitsubishi Gas Chemical Company, Inc.) | 300 parts |
| Antioxidant (a compound shown below) | 6 parts |
| THF/toluene mixed liquid (volume ratio: 3/1) | 2000 parts |

-continued

| | |
|---|---|
| Silicone oil (KF-54, produced by Shin-Etsu Chemical Co., Ltd.) | 1 Part |

The above-described were mixed and dissolved to prepare a charge transport layer coating solution. This coating solution was coated on the foregoing charge generation layer by an immersion coating method, and dried at 110° C. for 70 minutes to form a charge transport layer having a dry thickness of 20.0 μm, whereby photoreceptor 1 was prepared.

AO-1

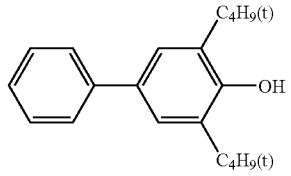

Preparation of Photoreceptors 2-10

Photoreceptors 2-10 were prepared similarly to preparation of photoreceptor 1, except that a charge generation layer coating solution for photoreceptor 1 was changed from dispersion 1 to each of dispersions 2-10 as shown in Table 2.

Evaluation

A remodeled digital complex copier bizhub920, manufactured by Konica Minolta Business Technologies, Inc., was used for evaluation (a semiconductor laser having an emission wavelength of 405 nm was used, and the complex copier was modified so as to irradiate at 1200 dpi with a beam diameter of 30 μm), and each of photoreceptors 1-10 was installed in the complex copier to conduct evaluation. The evaluation items and evaluation criteria are shown below.

Evaluation of Memory Property

The paper sheet providing durability test of the photoreceptor was conducted at normal temperature and humidity (20° C. and 50% RH). The durability test was done in an intermittent mode to stop once for every printing paper sheet provided. When lattice images of black and white were printed at an initial stage of the durability test and immediately after printing 10,000 paper sheets, and halftone images having a density of 0.4 were continuously printed, appearance of a lattice pattern memory image in the halftone image was evaluated in the following criteria.

A: No memory image is generated (No practical problem).

C: A memory image is generated (Practical problem).

Evaluation of Leakage Resistance

The same paper sheet providing durability test as above was conducted, and 5 paper sheets of white images each were output at the initial stage and immediately after printing 10,000 paper sheets to evaluate via observation of black spot occurrence frequency. The black spot occurrence frequency was determined by how many black spots having a major axis of at least 0.4 mm per A4 size paper sheet were observed.

A: Occurrence frequency of black spots having a major axis of at least 0.4 mm; 3 black spots in the total images, and in smaller size paper sheet than A4.

B: Occurrence frequency of black spots having a major axis of at least 0.4 mm; 4 black spots in larger size paper sheet than A4, and at least one paper sheet produced with 10 black spots in smaller size paper sheet than A4.

C: Occurrence frequency of black spots having a major axis of at least 0.4 mm; at least one paper sheet produced with 10 black spots in larger size paper sheet than A4.

TABLE 2

| Photoreceptor No. | Dispersion No. | Memory property | Leakage resistance | Remarks |
|---|---|---|---|---|
| Photoreceptor 1 | Dispersion 1 | C | B | Outside the Present invention |
| Photoreceptor 2 | Dispersion 2 | A | B | Within the Present invention |
| Photoreceptor 3 | Dispersion 3 | A | B | Within the Present invention |
| Photoreceptor 4 | Dispersion 4 | A | A | Within the Present invention |
| Photoreceptor 5 | Dispersion 5 | C | B | Outside the Present invention |
| Photoreceptor 6 | Dispersion 6 | A | C | Outside the Present invention |
| Photoreceptor 7 | Dispersion 7 | A | C | Outside the Present invention |
| Photoreceptor 8 | Dispersion 8 | A | B | Within the Present invention |
| Photoreceptor 9 | Dispersion 9 | A | B | Within the Present invention |
| Photoreceptor 10 | Dispersion 10 | A | A | Within the Present invention |

As is clear from Table 2, it is to be understood that photoreceptors 2-4 and 8-10 each containing particles made of a condensed polycyclic pigment, having an average major axis length of 500 nm or less, an average aspect ratio of 2.5-5.0, and an aspect ratio variation coefficient of 16% or less exhibit excellent leakage resistance together with an excellent memory property. In contrast, it is also to be understood that photoreceptors 1 and 5-7 in which any of an average major axis length, an average aspect ratio and an aspect ratio variation coefficient falls outside the range of the present invention, exhibit degradation of either the memory property or the leakage resistance, even though the identical condensed polycyclic pigment is employed.

EFFECT OF THE INVENTION

Generation of memory images as well as image defects caused by very small charge leakage can be inhibited by utilizing an organic photoreceptor of the present invention, and it becomes possible to prepare high definition electrophotographic images with a short wavelength exposure light source.

What is claimed is:

1. An organic photoreceptor comprising a charge generation layer and a charge transport layer provided on a conductive support, wherein the charge generation layer comprises particles made of a condensed polycyclic pigment, having an average major axis length of 500 nm or less, an average aspect ratio of 2.5-5.0, and an aspect ratio variation coefficient of 16% or less, wherein the condensed polycyclic pigment is a compound represented by the following Formula (1):

Formula (1)

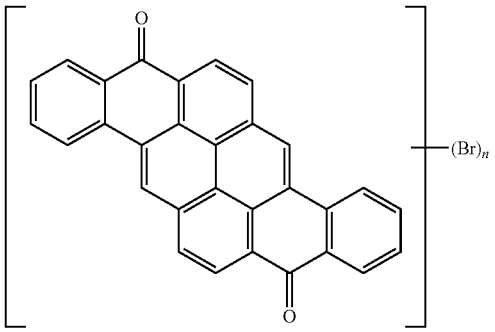

, wherein n is an integer of 1-6, the charge generation layer formed by coating a dispersion prepared via multi-dispersion steps comprising:

(a) dispersing the particles made of the condensed polycyclic pigment with no binder, and (b) dispersing the particles made of the condensed polycyclic pigment with a binder.

2. The organic photoreceptor of claim 1, wherein the condensed polycyclic pigment is a charge generation material.

3. The organic photoreceptor of claim 2, wherein the charge generation layer comprises the charge generation material and a binder resin, the charge generation material having a content of 20-600 parts by weight, with respect to 100 parts by weight of the binder resin.

4. An image forming apparatus comprising:

the organic photoreceptor of claim 1;

a charging device to charge the organic photoreceptor;

an exposure device to form an electrostatic latent image by exposing the organic photoreceptor charged with the charging device to light;

a developing device to form a toner image via development of the electrostatic latent image with a toner; and a transfer device to transfer the toner image from the organic photoreceptor to a transfer medium, wherein the exposure device comprises an exposure light source of monochromatic light having a wavelength of 350-500 nm.

* * * * *